United States Patent [19]

Marley

[11] 4,326,703

[45] Apr. 27, 1982

[54] CUT LOG SECTION HOLDER FOR LOG SPLITTING OPERATION

[76] Inventor: William R. Marley, 147 Filmore St., Pocatello, Id. 83201

[21] Appl. No.: 182,396

[22] Filed: Aug. 26, 1980

[51] Int. Cl.[3] ..... B25B 1/00

[52] U.S. Cl. ..... 269/156; 269/239; 269/209; 269/211; 269/254 CS; 269/287; 248/523

[58] Field of Search ..... 269/156, 254 R, 254 CS, 269/237-239, 209, 207, 211, 212, 287, 908; 248/519, 523, 524, 226.2

[56] References Cited

U.S. PATENT DOCUMENTS

| | | | |
|---|---|---|---|
| 1,198,365 | 9/1916 | Manney | 269/156 |
| 1,540,856 | 6/1925 | Munro | 248/523 |
| 1,619,749 | 3/1927 | Murray | 269/209 |
| 2,221,923 | 11/1940 | Passaver | 269/209 |
| 2,639,877 | 5/1953 | Fox | 248/523 |
| 3,480,241 | 11/1969 | Moyer | 248/524 |
| 4,239,198 | 12/1980 | Trupp | 269/156 |

FOREIGN PATENT DOCUMENTS

| | | | |
|---|---|---|---|
| 486114 | 9/1952 | Canada | 269/254 CS |

*Primary Examiner*—Robert C. Watson

*Attorney, Agent, or Firm*—Harvey B. Jacobson

[57] ABSTRACT

A generally rectangular frame is provided for disposition on a horizontal surface and first and second adjacent sides of the frame define convergent gripping jaws and a horizontally opening crotch at the convergent ends of the jaws for frictionally gripping adjacent peripherally spaced surfaces of a log section. An elongated third jaw is provided and pivot structure releasably pivotally attaches one end of the third jaw to selected points spaced along the first jaw for swinging of the other end of the third jaw toward and away from the end portion of the second jaw remote from the first jaw. Biasing structure is operatively connected between the third jaw and the frame and yieldably biases the third jaw to swing in a direction toward the second jaw. The side of the third jaw facing the first and second jaws as well as the sides of the first and second jaws facing the third jaw are provided with longitudinally spaced teeth and the biasing structure operatively connected between the third jaw and the frame includes an elongated tension member yieldingly attached at one end to one of the third and second jaws remote from the first jaw and the other end thereof releasably anchorable, at points spaced therealong, to the other of said second and third jaws.

8 Claims, 5 Drawing Figures

42
40
36

12
2
30
62
60
2
26
34
66
30
22
56
22

34
62
22
60
24
14
28
30
26

CUT LOG SECTION HOLDER FOR LOG SPLITTING OPERATION

BACKGROUND OF THE INVENTION

Many forms of apparatuses heretofore have been designed for the purpose of splitting cut log sections whereby the split log sections may be conveniently placed into fireplaces and room heaters. Conventionally, an ax is used by an experienced person and swung against the end of a cut log section for splitting the same. However, efficient use of an ax requires considerable skill and strength and some larger diameter cut log sections may not be readily split with an ax.

Other methods of splitting log sections include the use of a heavy hammer or sledge and splitting wedges, but this method also requires considerable expertise and strength. Further, yet another method of splitting logs involves the use of a hydraulic log splitter, but log splitters of this type are very expensive and thus not practical for a person wishing to occasionally split logs. Finally, logs may also be split manually through the utilization of a splitting maul. A splitting maul is considerably heavier than an ax and relies upon its increased weight for accomplishing the desired splitting action under the use of a person having less than maximum strength. However, use of a splitting maul by less than fully skilled persons requires that the log section to be split be firmly supported in an upstanding position. In addition, all forms of manual cut log section splitting operations are facilitated if the log section to be split may be securely held in an upright position. Accordingly, a need exists for an apparatus by which cut log sections may be conveniently securely supported in upstanding positions.

Few holders for supporting log sections in upstanding positions heretofore have been provided. Examples of holding structures of various types including some of the general structural and operational features of the instant invention are disclosed in U.S. Pat. Nos. 167,127, 1,048,643, 1,873,406 and 4,054,297.

BRIEF DESCRIPTION OF THE INVENTION

The cut log holder of the instant invention comprises a generally rectangular frame for disposition upon a suitable horizontal support surface such as the ground and the lower end of the frame is closed. One pair of adjacent sides of the frame include longitudinally spaced inwardly opening teeth for engaging an upstanding log section placed in the crotch defined between the convergent ends of the teeth-equipped sides of the frame and an elongated jaw member has one end thereof pivotally attached to the end of one of the frame sides remote from the other frame side and yieldable tension structure is operatively connected between the frame and the free end of the jaw member functioning to yieldingly bias the pivoted jaw in a direction toward the second frame side. In this manner, an upstanding log section engaged between the first and the second tooth-equipped sides of the frame and the jaw member will be securely held in upright position in a manner such that a splitting maul, ax or other splitting tool may be impacted with the upper end thereof.

The main object of this invention is to provide an apparatus which would be capable of stationarily supporting a cut log section in upstanding position.

Another object of this invention is to provide an apparatus for supporting an upstanding cut log section in a manner such that splitting action thereon by an ax or splitting maul will not result in chips or pieces of wood flying away from the position in which the cut log section is supported.

Still another object of this invention is to provide a cut log section holder for supporting a cut log section in upstanding position and which will thereby obviate the necessity of a person splitting wood from having to hold a cut log section in upright position while attempting to split the log section.

Still another important object of this invention is to provide a log holder for supporting log sections to be split and which will substantially eliminate the necessity of the person splitting the log section to bend over and pick up the split sections of log after the log section has been split.

Another important object of this invention is to provide a log holder in accordance with the preceding objects and which will be capable of supporting cut log sections in upright position even when the log sections do not include square ends.

A final object of this invention to be specifically enumerated herein is to provide a cut log section holder in accordance with the preceding objects and which will conform to conventional forms of manufacture, be of simple construction and easy to use so as to provide a device that will be economically feasible, long lasting and relatively trouble free in operation.

These together with the other objects and advantages which will become subsequently apparent reside in the details of construction and operation as more fully hereinafter described and claimed, reference being had to the accompanying drawings forming a part thereof, wherein like numerals refer to like parts throughout.

DETAILED DESCRIPTION OF THE INVENTION

Figure 1:
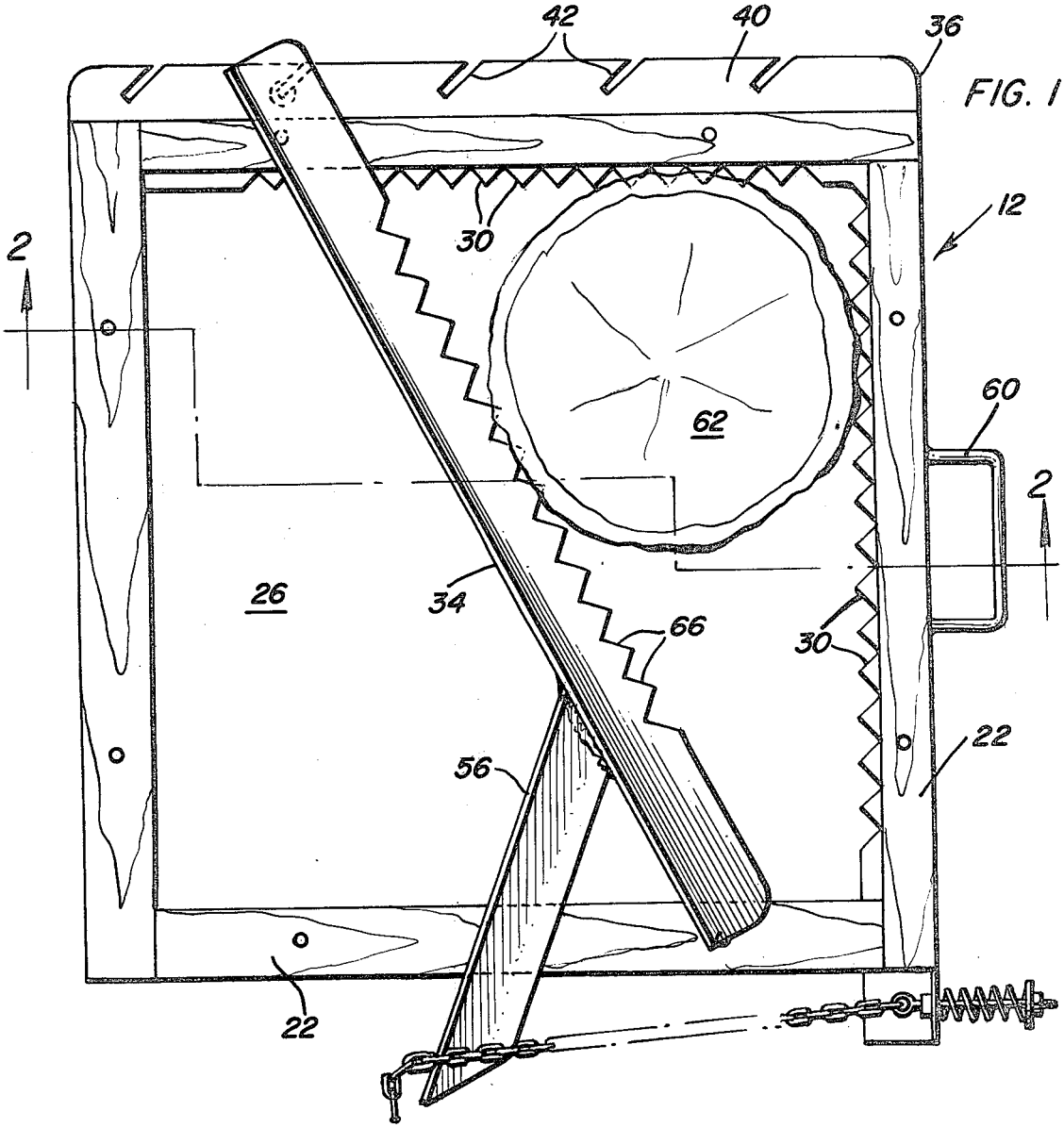
FIG. 1 is a top plan view of the cut log section holder of the instant invention.
Figure 2:
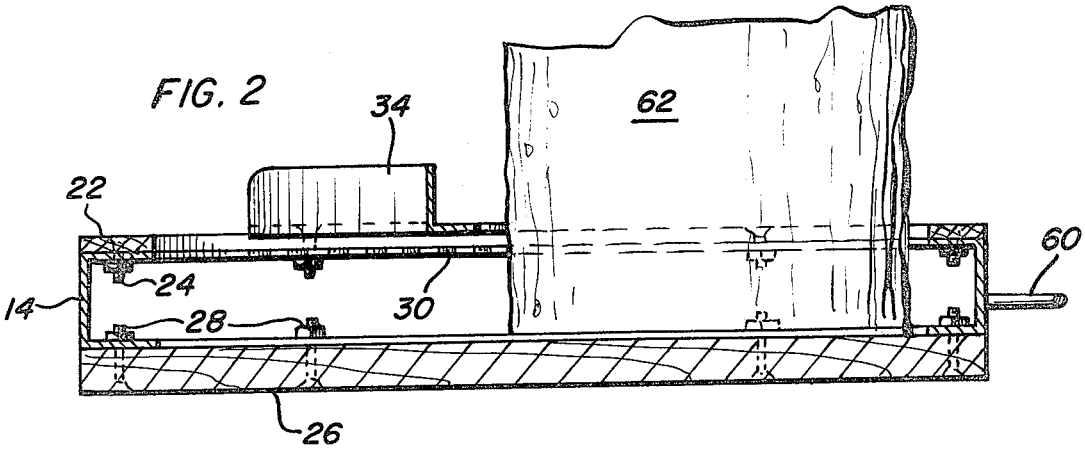
FIG. 2 is a vertical sectional view taken substantially upon the plane indicated by the section line 2—2 of FIG. 1.
Figure 3:
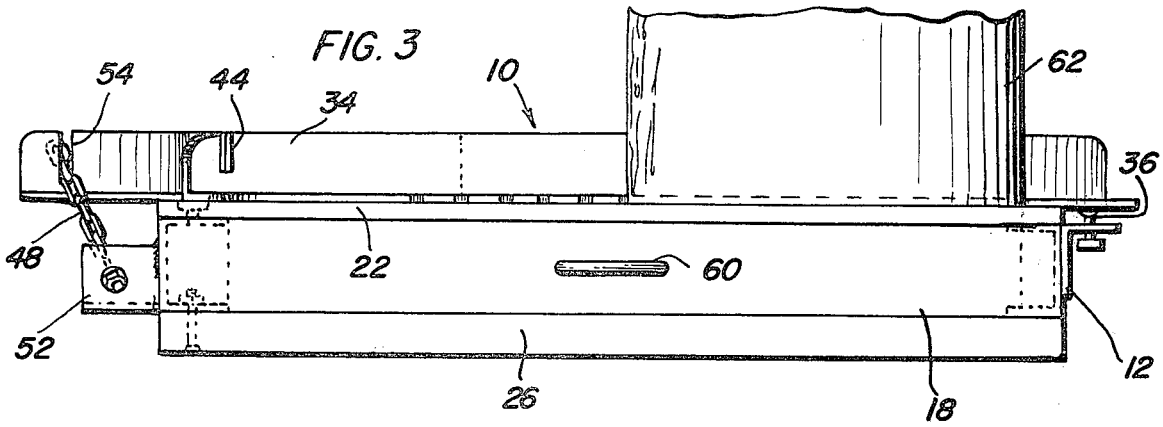
FIG. 3 is a side elevational view of the assemblage illustrated in FIG. 1 as seen from the right side thereof.

Referring now more specifically to the drawings, the numeral 10 generally designates the cut log section holder of the instant invention. The holder 10 includes a rectangular frame 12 or base including right angularly disposed pairs of opposite sides 14, 16, 18 and 20. The sides 14, 16, 18 and 20 comprise inwardly opening channel members and each has a protective wood strip 22 secured to its upper surface by suitable fasteners 24. In addition, the underside of the horizontal frame 12 is closed by a bottom panel 26 secured to the undersurfaces of the channel members by suitable fasteners 28.

The sides 16 and 18 have inwardly facing toothed plates 30 secured thereto by the corresponding fasteners 24 in underlying relation relative to the upper horizontal flange portions of the corresponding channel members and the sides 16 and 18 define generally straight horizontal jaw members convergent toward one pair of corresponding ends between which a crotch 32 is defined.

A third jaw defining angle member 34 has a depending pivot pin 36 supported from one end and the side 16 has an angle member 38 supported therefrom including an upper horizontally outwardly directed flange 40 provided with longitudinally spaced slots or notches 42 therein. The notches 42 open outwardly of the outer free side of the flange 40 and are outwardly inclined toward the end of the flange 40 adjacent the side 18.

The pivot fastener 36 is receivable in a selected notch 42 and the third jaw 34 may, accordingly, be pivotally anchored to the side 16 at points spaced longitudinally therealong. The end of the jaw 34 remote from the pivot fastener 36 slidably engages the upper surface of the wood strip 22 supported from the side 20 and includes an upstanding flange portion having a notch 44 formed therein in which a selected link 46 of a link chain section 48 may be engaged. One end of the link chain section 48 is anchored relative to a compression spring biased anchor pin 50 slidingly received through an anchor flange 52 carried by the end of the side 18 remote from the side 16. A selected link 46 may be engaged in the notch 44 or in a similar notch 54 formed in an angle member 56 anchored and angulated relative to the free end of the jaw 34.

The outer side of the side 18 is equipped with a carrying handle 60 and it will thus be apparent that the holder 10 may be conveniently carried from one location to another.

In operation, cut log section 62 may be disposed in upright position on the panel 26 within the crotch 32 and the link chain section 48 may be adjustably engaged with the notch 44 or the notch 54 in order to enable the spring-biased pin 50 to yieldingly swing the jaw 34 into frictional engagement with the side of the log section 62 remote from the crotch 32, the jaw 34 including longitudinally spaced teeth 66. If the log section 62 is much larger in diameter than illustrated in FIG. 4, the link chain section 48 may be engaged with the notch 44. In addition, if the log section 62 is considerably smaller in diameter than illustrated in FIG. 4, the pivot pin 36 may be engaged with a notch 42 closer to the end of the side 16 adjacent the side 18.

Figure 4:
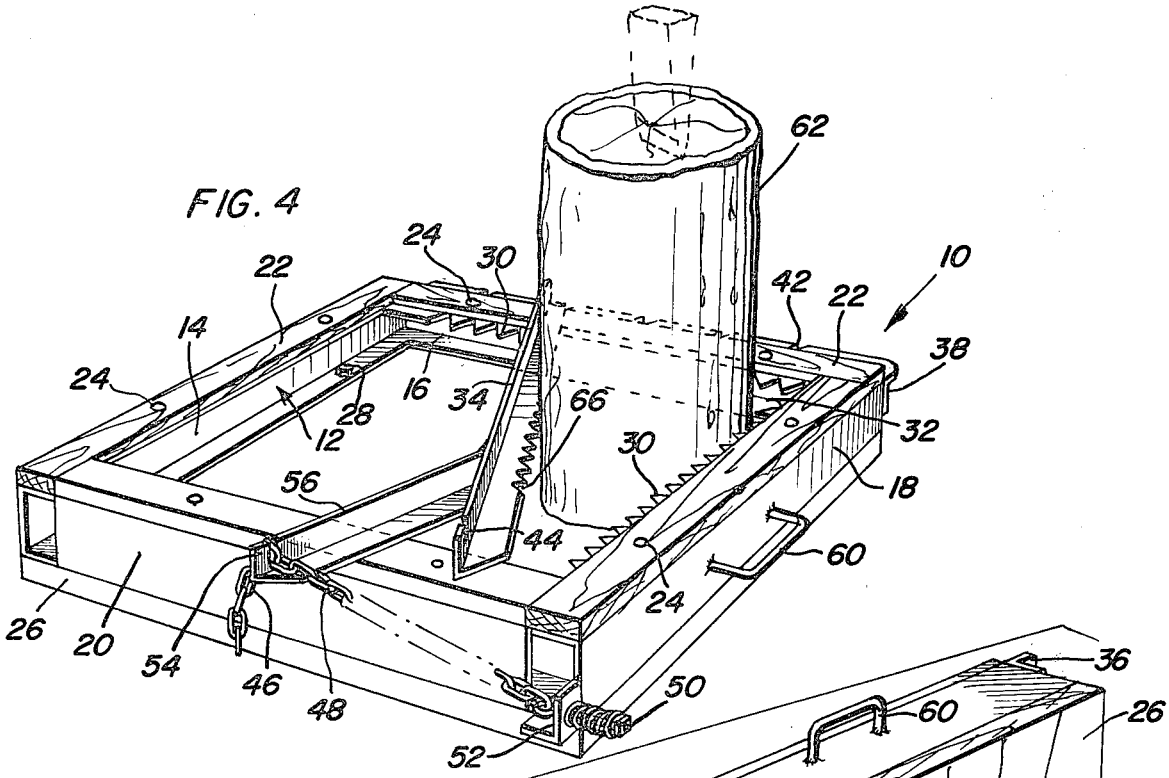
FIG. 4 is a perspective view of the assembly illustrated in FIG. 1 on somewhat of a reduced scale.
Figure 5:
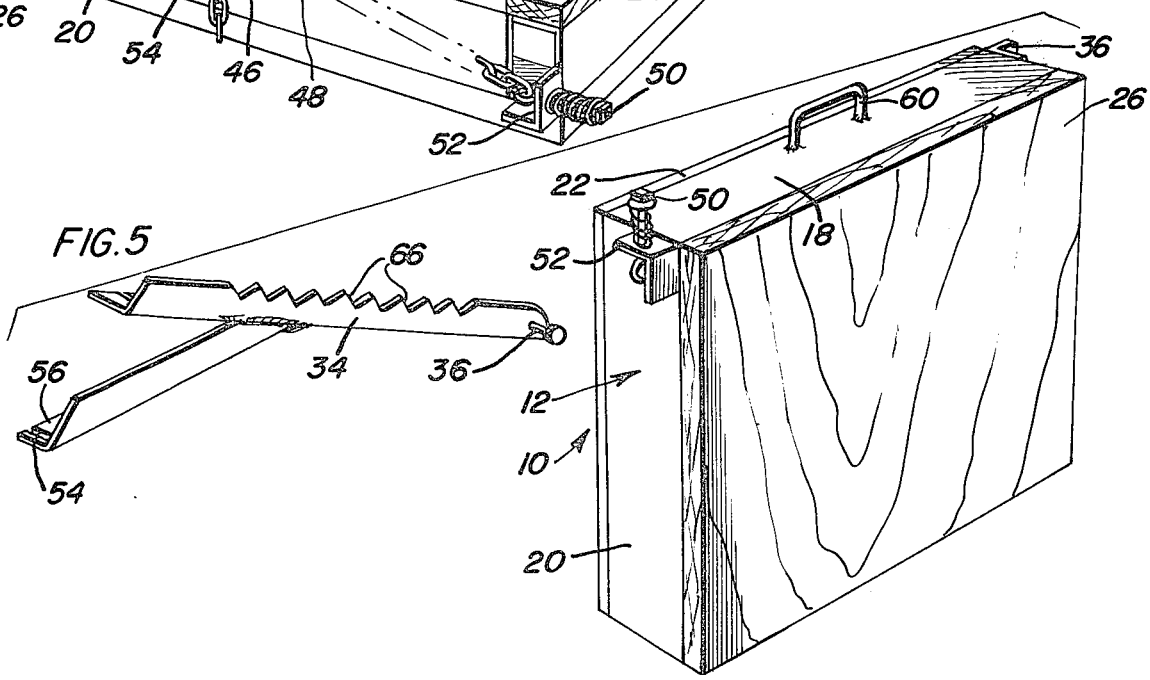
FIG. 5 is an exploded perspective view of the cut log section holder as seen from the underside thereof and with the pivoted jaw thereof in an exploded position.

Of course, when the log section 62 is firmly supported in the upstanding position thereof illustrated in FIG. 4 of the drawings, an ax, splitting maul or splitting wedge may be engaged with the upper end of the log section 62 in order to split the same. After the log section 62 has been split, the split sections of the log section 62 are retained in upstanding position and may be readily removed from the holder 10 without bending over.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A cut log section holder for holding cut log sections during splitting operations, said holder defining a base for suitable support from a supportive surface, said base defining a pair of generally horizontal, relatively angulated, elongated and convergent first and second gripping jaws defining a horizontally opening crotch adjacent their convergent ends for frictionally gripping adjacent peripherally spaced surfaces of an upstanding log section, said first jaw including longitudinally spaced notches formed therein opening outwardly of the side thereof remote from the second jaw, an elongated third jaw having pivot pin means on one end thereof removably and pivotably receivable in a selected notch of said notches for swinging movement of the other end of said third jaw toward and away from the end portion of said second jaw remote from said first jaw, said other end of said third jaw and the end portion of said second jaw remote from said first jaw including means defining corresponding anchor points, an elongated tension member, first anchor means anchoring one end portion of said tension member to one of said anchor points, the other end portion of said tension member and the other anchor point including means for readily releasably anchoring selected longitudinally spaced portions of the second end portion of said tension member to said other anchor point, said first anchor means incorporating yieldable means for adjusting tension lengthwise of said tension member.

2. The cut log section holder of claim 1 wherein said yieldable means includes a coiled compression spring arranged for increased compression as the tension of said tension member is increased.

3. The holder of claim 1 wherein said base comprises a generally rectangular frame, said first and second jaws comprising adjacent sides of said frame.

4. The holder of claim 3 wherein the underside of said rectangular frame is closed by a panel secured thereacross.

5. The holder of claim 3 wherein the sides of said frame include upper surface impact absorbing means supported therefrom.

6. The holder of claim 5 wherein the underside of said rectangular frame is closed by a panel secured thereacross.

7. The holder of claim 1 wherein said means defining said other anchor point includes means defining a pair of anchor points spaced transversely of the longitudinal extent of said third jaw, said other end portion of said tension member being selectively engageable with said pair of transversely spaced anchor points.

8. The holder of claim 7 wherein said third jaw includes a pair of transversely spaced upstanding flanges adjacent the free end of said third jaw, a pair of notches formed in the upper surfaces of said upstanding flanges, said notches defining said pair of anchor points.

* * * * *